US007258317B1

(12) United States Patent
Nagel

(10) Patent No.: US 7,258,317 B1
(45) Date of Patent: Aug. 21, 2007

(54) PULL-OUT DISPLAY SHELF

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 541 days.

(21) Appl. No.: 10/829,912

(22) Filed: Apr. 22, 2004

(51) Int. Cl.
*E04G 3/20* (2006.01)

(52) U.S. Cl. ..... 248/244; 248/243; 108/108; 108/143

(58) Field of Classification Search ..... 248/220.42, 248/220.43, 241, 242, 244; 312/408, 333; 108/102, 106–108, 137, 143, 152; 211/90.02, 211/175
See application file for complete search history.

(56) References Cited

U.S. PATENT DOCUMENTS

| | | | | | |
|---|---|---|---|---|---|
| 745,873 | A | * | 12/1903 | Mancha | 248/243 |
| 2,564,473 | A | | 8/1951 | Ferguson | |
| 3,207,100 | A | * | 9/1965 | Peacock | 108/152 |
| 3,248,079 | A | * | 4/1966 | Kennedy | 248/242 |
| 4,378,925 | A | * | 4/1983 | Griffin | 248/242 |
| 4,589,349 | A | * | 5/1986 | Gebhardt et al. | 108/102 |
| 4,610,487 | A | * | 9/1986 | Delmege et al. | 384/18 |
| 4,705,175 | A | | 11/1987 | Howard et al. | |
| D295,950 | S | * | 5/1988 | Johnston | D8/381 |
| 4,799,802 | A | | 1/1989 | Lautenschlager | |
| 5,346,077 | A | * | 9/1994 | Randall | 211/90.03 |
| 5,484,068 | A | * | 1/1996 | Huang | 211/193 |
| 5,531,159 | A | * | 7/1996 | Stubblefield | 108/102 |
| 6,641,098 | B1 | * | 11/2003 | Proffitt | 248/243 |
| 6,799,523 | B1 | * | 10/2004 | Cunha | 108/108 |

FOREIGN PATENT DOCUMENTS

| | | |
|---|---|---|
| EP | 0730424 B1 | 7/1999 |
| WO | WO 01/21040 A1 | 3/2001 |

* cited by examiner

*Primary Examiner*—Korie Chan
(74) *Attorney, Agent, or Firm*—Schweitzer Cornman Gross & Bondell LLP

(57) ABSTRACT

A pull-out display shelf assembly having spaced-apart support structures mounted on gondola uprights, for example, and supporting a display shelf for movement between fully retracted and extended positions, with locking means for securing the shelf structure in any set position. The locking mechanism includes vertically rotatable square locking bars freely movable in a locking track when aligned therewith, and having locking engagement with the track when rotated out of alignment with the track. Simplified and improved support structures are formed of heavy gauge sheet metal, bent into an L-shaped configuration for strength and rigidity and formed to provide elongated locking slots in horizontal bottom panels of the L-shaped supports. Component parts are minimized and rigidity and locking action are improved. Stabilizing tabs at the inner ends of the support brackets minimize lateral flexing of the brackets when the shelf is released for movement relative to the support brackets.

5 Claims, 3 Drawing Sheets

14
15
16
(15)
17
18
19
20
21
22
23
24
25
26
27
28
29
30
31
34
37
38
39
40
43
44

PULL-OUT DISPLAY SHELF

BACKGROUND OF THE INVENTION

The display of merchandise in mass merchandising outlets and the like typically involves extensive shelving installations. Typical forms of display shelving comprise gondola structures forming support stands for the shelving. The gondolas may comprise a base from which extends a back wall panel including .two or more vertical uprights formed with slots or other openings to receive shelving at various levels. Stores frequently try to position shelves with relatively minimal vertical clearance between the contents of one shelf and the position of the shelf next above, in order to maximize the number of shelves, and therefore the amount of merchandise displayed, in a given gondola. However, as vertical shelf spacing becomes more compressed, it becomes more difficult to stock and service individual shelves, particularly lower shelves, because of the difficulty and inconvenience in reaching the back areas of the shelves.

To facilitate access to back portions of the display shelves, some stores install pull-out shelving. Pull-out shelves are mounted at their opposite side edges in such way as to enable them to be temporarily displaced forwardly from the back wall of the gondola, exposing significantly greater areas of the shelf surface, and thereby enabling store personnel to more easily restock and otherwise service the merchandise display. A known form of such pull-out shelving is illustrated in International Publication WO 01/21040 of H. L. Display A. B. The disclosed shelf structure includes a pair of spaced apart side supports which engage opposite end edges of a display shelf, using roller tracks or the like to accommodate easy movement of the shelf even when loaded with product. Locking means are positioned underneath the shelf and are engageable by an operator servicing the shelf, enabling the shelf to be freed up for forward and rearward movement, but locking the shelf firmly in position when released. This allows the shelf to be pulled out for servicing, and then easily returned to its normal display position.

A shelf of the type disclosed in WO 01/21040, while functionally satisfactory, is of relatively complex, and therefore relatively costly construction, which tends to inhibit its widespread usage. The present invention is directed to an improved pull-out shelf structure, of the general type disclosed in WO 01/21040 which, at the same time not only provides superior performance but also is of a significantly improved and simplified (and therefore more economical) construction, and thus more suitable for more widespread employment in mass merchandising and other outlets.

SUMMARY OF INVENTION

Pursuant to the present invention, a pull-out shelf mechanism is provided in which the side supports for a movable shelving system are both significantly strengthened and simplified in structure, so as to achieve improved performance while at the same time reducing the cost of manufacturing the unit. In the prior art structure referred to, the side supports, in order to accommodate the necessary position locking arrangement, are of rather complex construction, involving several independent components requiring separate manufacturing, handling and assembly. In the structure of the invention, by contrast, the side supports are constructed of a rugged, one-piece metal shape, which both significantly strengthens the side support elements and simultaneously accommodates the locking mechanism without additional components. To this end, the side support elements are formed of a relatively heavy sheet metal material, shaped in a generally L-shaped cross section and thus having significant rigidity. The L-shaped configuration, comprising a vertical side wall and a horizontal bottom wall joined integrally and in one piece therewith, enables an elongated locking slot to be formed within the bottom panel, eliminating the need for extra parts to be constructed and installed as in the prior art mechanism.

In an assembly of spaced-apart side supports and a movable shelf member supported at its opposite end edges in the side supports, the assembly is inherently strong and rigid when the movable shelf is locked in a fixed position with respect to the side supports. When the shelf is unlocked, however, to accommodate forward or rearward movement, the mechanism can be somewhat laterally unstable, which can be exacerbated in some cases when the shelf is stocked with heavy merchandise and/or pulled out to an extended position. To ameliorate this lateral instability, the structure of the invention incorporates integral stabilizing elements adjacent the back ends of the respective side supports, which bear against vertical uprights on which the side supports are suspended, to resist lateral deflections of the side supports during periods when the shelf supported thereby is unlocked for movement.

For a more complete understanding of the above and other features and advantages of the invention, reference should be made to the following detailed description of a preferred embodiment of the invention, and to the accompanying drawings.

DESCRIPTION OF A PREFERRED EMBODIMENT

Figure 1:
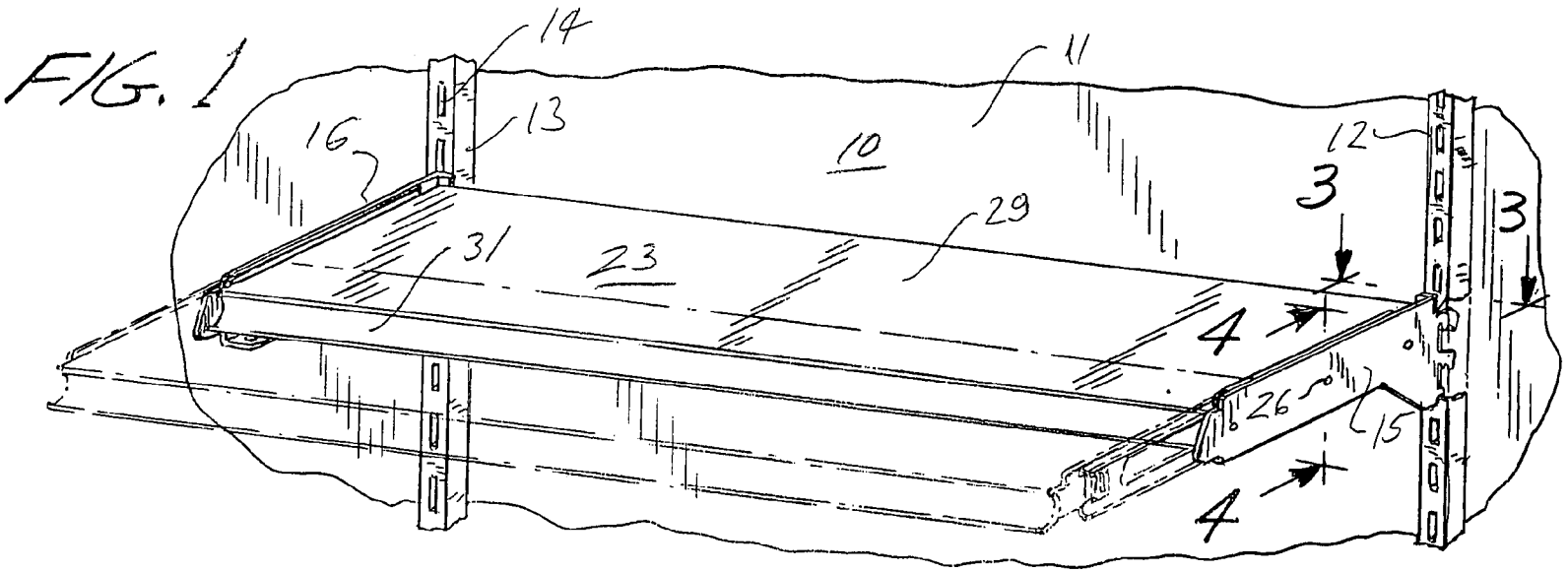
FIG. 1 is a fragmentary perspective view of a pull-out shelf assembly according to the invention, shown mounted on a typical gondola structure.
Figure 2:
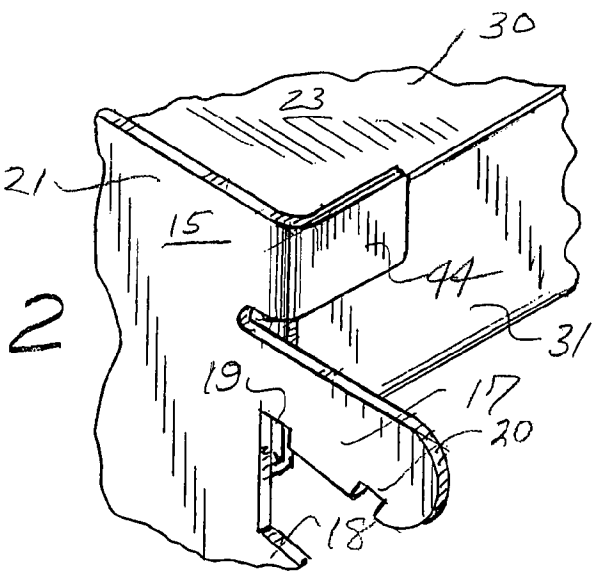
FIG. 2 is an enlarged, fragmentary perspective view illustrating features of side support elements of the invention.

Referring now to the drawings, the reference numeral 10 designates a typical gondola structure used in many point-of-purchase displays and typically including a base structure (not shown), a back wall 11 and spaced uprights 12, 13. The uprights 12, 13 typically may be spaced on four foot centers, and are formed with a plurality of vertical disposed slotted openings 14 for mounting shelf side supports 15, 16. These supports are formed with notched mounting tabs 17, 18, one above the other, which are adapted to be inserted into vertically adjacent pairs of the slotted openings 14. Notches 19 engage the uprights 12, 13 at the lower ends of the slotted openings 14, to lock the side supports in assembled relation to the vertical uprights. Typically, the mounting tabs are provided with secondary notches 20, which enable the shelf assembly to be mounted with a downward slant, which is useful in the display of certain types of merchandise.

Pursuant to the invention, the side supports 15, 16 are formed of relatively heavy sheet metal material, such as twelve gauge cold roll steel. Each side support is formed of a single piece of material, shaped to form a vertical outer wall panel 21 and a horizontal bottom panel 22. The outer wall panel 21 extends for the full length of the support bracket, while the bottom panel 22 can be inset somewhat from each end of the support bracket. The L-shaped cross section of the bracket (evident in FIGS. 4 and 5) imparts significant strength and rigidity to the bracket and, as will appear, simplifies its construction in significant ways.

Figures 4, 5:
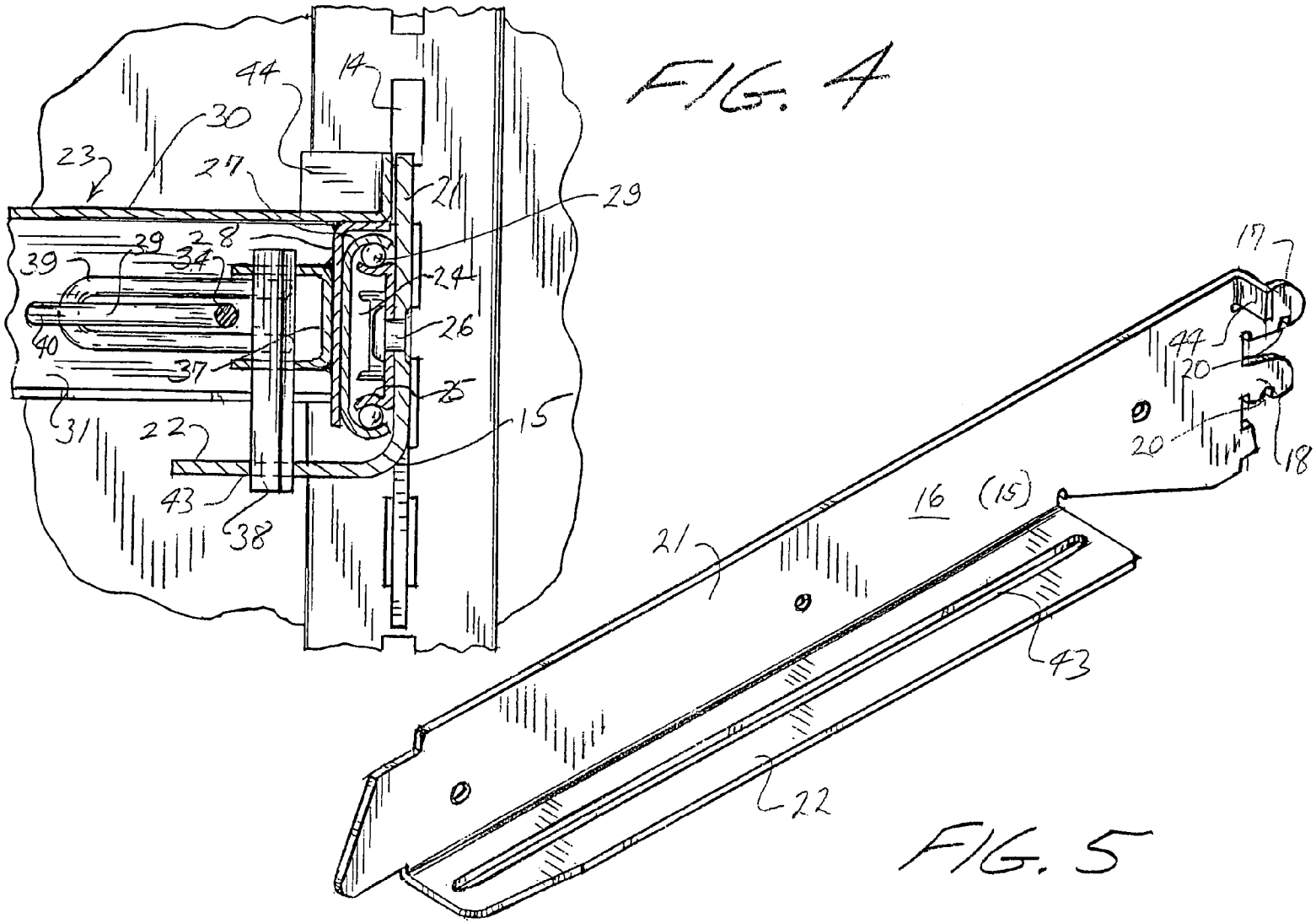
FIG. 5 is a perspective view of a side support element forming part of the invention.

A shelf assembly 23 is supported at its opposite end edges by the brackets 15, 16 for front-to-back sliding motion relative to the brackets. To this end, roller bearing slides 24 are provided at each side edge. As shown in FIG. 4, the roller bearing slides comprise an inner member 25, secured by rivets 26 to the support brackets 15, 16, and an outer slide member 27 secured to a side wall panel 28 at each end edge of the shelf structure. A plurality of bearing balls 29 are confined between the respective slide elements 25, 27 providing anti-frictional support for the slide structure, all in a generally well known manner.

In a typical case, the shelf structure will include a top wall panel 30 joined rigidly with the side wall panels 28, a rear wall 31, and a front wall panel 32. The latter advantageously can be given a somewhat C-shaped cross sectional configuration to serve as a label holder.

Figure 6:
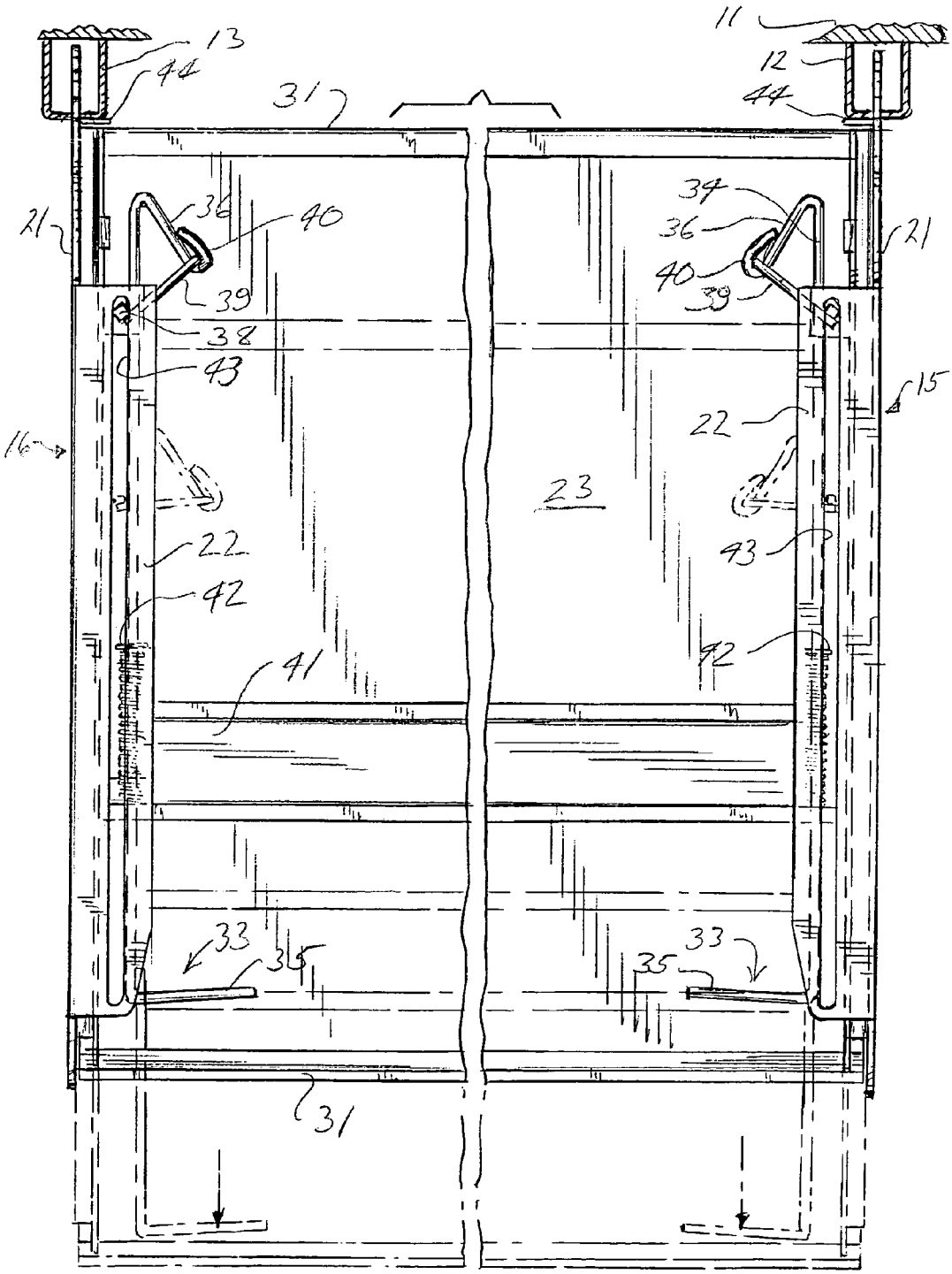
FIG. 6 is a bottom plan view of an installed shelf assembly according to the invention.

The structure of the invention includes a locking mechanism for securing the shelf assembly 23 in a preset position (typically fully retracted or fully extended, but also anywhere between those extremes). For this purpose, the locking mechanism incorporated in the structure of the invention utilizes in part a useful form of mechanism shown in WO 01/21040, in conjunction with significant improvements forming features of the present invention. With particular reference to FIGS. 4 and 6, the shelf structure 23 is provided with trigger mechanisms 33 at each side which control the locking and release of the shelf structure. The operator manually engages and pulls both trigger mechanisms in order to release the shelf structure for movement in or out, and releases the trigger mechanisms in order to lock the shelf structure in its set position.

Each of the trigger mechanisms 33 include an elongated actuator wire 34 which extends adjacent to and generally parallel with the side walls 28 of the shelf structure. The actuator wires terminate at the front in gripping elements 35, which project laterally inward toward the center of the shelf structure, and terminate at the back with connecting links 36. A horizontally disposed, U-shaped pivot bracket 37 (FIG. 4) is secured to each of the shelf side wall panels 28 near the back of the shelf structure. The U-shaped bracket rotatably mounts a vertically disposed locking bar 38, which advantageously may be formed of quarter inch square key stock. A horizontally disposed, U-shaped actuating lever 39 is welded to one side surface of the locking bar 38 within the arms of the U-shaped mounting bracket 37. The actuating lever 39 thus serves to axially position the locking bar 38 within the spaced arms of the mounting bracket 37, and also provides lever means for rotating the locking bar. As shown in FIG. 6, an end portion 40 of the connecting link 36 is looped around the end of the actuating lever 39 to connect the lever with the actuating wire 34. Accordingly, linear movements of the actuating wire 34 will result in rotation of the locking bar 38 about the vertical axis in which it is supported by the pivot bracket 37.

In the illustrated arrangement, the actuating wires are supported near their front ends by passing through portions of a transverse stiffening bar 41, and adjacent their back ends by passing between the upper and lower legs of the U-shaped actuating levers 39 (see FIG. 4). Springs 42 engage the actuating wires 34 urging them normally in a rearward direction which, as will be described, serves to lock the shelf structure in position with respect to the mounting brackets 15, 16. When an operator engages the elements 35 and draws the actuating wires forwardly, against the action of the springs, the shelf is temporarily released for movement in either direction.

As is evident in FIGS. 4 and 6, when the trigger mechanisms 33 are in their "normal" positions, the locking bars 38 are disposed at an angle to elongated locking slots 43 formed in the bottom wall panels 22. The width of the slots is slightly greater than the side wall dimensions of the square locking bars 38, but significantly less than the corner to corner diagonal dimensions of the locking bars. When the trigger mechanisms 33 are released, the springs urge the actuating wires to the rear, pivoting the locking bars 38 in a direction tending to align the diagonal dimensions of the locking bars crosswise in their respective slots 43. This causes the opposite corners of the locking bars to engage the side walls of the slots, locking the shelf structure against movement in either direction.

While the general principles of the locking mechanism thus far described are explained in the beforementioned WO 01/21040 publication, the mechanism of that prior art publication utilizes a somewhat complex and expensive, multipart structure, in conjunction with the locking mechanism, including a special U-shaped channel for receiving the locking bar. In the shelf structure of the present invention, a greatly simplified arrangement is provided for the locking mechanism, which is simpler and less costly to manufacture, and achieves superior results at the same time.

Pursuant to the invention, the integral bottom walls 22 of the side supports 15, 16 is formed with the elongated slots 43, which are punched or milled into the heavy gauge sheet material of the side supports. The slots 43 run for a length equal to or slightly exceeding the maximum travel of the locking bars 38. When the trigger mechanisms are drawn forwardly by an operator, the locking bars 38 are rotated out of contact with the side walls of the slot 43, allowing the shelf structure to be moved freely on the roller slides 24. When the trigger mechanisms are released, the springs 42 cause the locking bars to be rotated to bring opposed corners thereof into contact with the side walls of the slot to lock the shelf in any position, generally as previously described.

As will be understood, the slots 43 are formed in the horizontal bottom panel 22 of the side support, which provides a substantial expanse of metal in the plane in which locking forces are applied by the locking bar 38. In the illustrated embodiment, for example, slots of around 0.3 inch in width are formed with about ⅝ inch of panel width on both sides thereof. This compares, for example, to the opposite side walls of a U-shaped channel, in which the resisting force to the locking bar action is provided only by the channel side walls, which are mounted in a cantilever fashion at the bottom of the channel. Additionally, the engagement of the locking bar 38 with the side walls of the channel 43 takes place over a relatively short axial distance equal to the thickness of the sheet metal (approximately one eighth inch in the illustrated instance) such that there is a significant concentration of locking forces between the locking bars 38 and the side walls of the slots 43, as compared to the cooperative action of a locking bar within a U-shaped channel, for example. Thus, in the structure of the present invention, the use of the one-piece, heavy gauge sheet metal supports to provide a slot for the locking mechanism provides a superior mechanism at a lower manufacturing cost, with fewer parts, fewer assembly operations and better performance.

Figure 3:
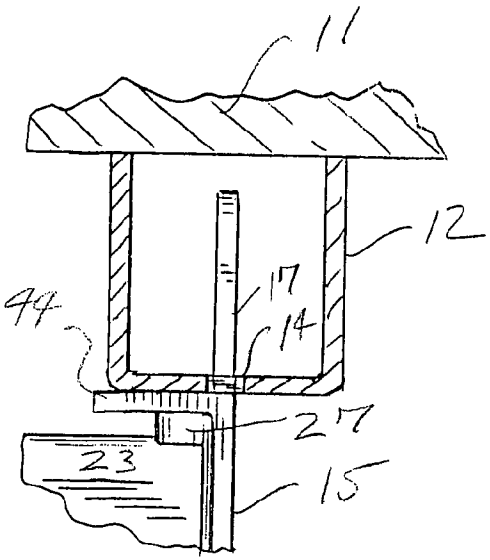
FIGS. 3 and 4 are enlarged, fragmentary, cross sectional views as taken generally on lines 3-3 and 4-4 respectively of FIG. 1.

As previously mentioned, when the shelf structure 23 is locked together with the side supports 15, 16, the entire structure is very rigid and stable. However, during those moments when the locking mechanisms are released, there is minimum resistance to lateral deflection of the assembly. For this reason, the structure of the invention incorporates laterally extending stabilizing tabs 44 at the inner ends of the support brackets 15, 16, immediately adjacent to the mounting tabs 17, 18. These stabilizing tabs are integral with the side panels 21 of the support brackets, and are bent at right angles thereto such that, when the mounting tabs 17, 18 of the support brackets are properly installed on the uprights 12, 13, the outer (rear) faces of the stabilizing tabs abut the outer faces of the uprights, as shown particularly in FIG. 3.

The stabilizing tabs 44 function to minimize lateral deflection of the support brackets 15, 16 relative to the uprights 12, 13 and thus add significant stability to the assembly as a whole during times when the shelf structure is released from the support brackets and is in motion either in an inward or an outward direction. The provision of the stabilizing tabs 44 enables the side support brackets 15, 16 to be utilized without use of a special stabilizing structure (e.g., cross bracing or the like) extending between and connecting the brackets. The brackets can be connected solely by the uprights 12, 13 and by the shelf structure 23.

The mechanisms of the invention enable many of the advantageous features of the prior art, as disclosed in WO 01/21040, to be utilized while at the same time providing for an assembly which not only provides superior performance but does so with a significantly more simplified structure and a correspondingly lower manufacturing cost.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a pull-out display shelf assembly of the type comprising laterally spaced-apart side support structures engageable at inner ends thereof with a vertical shelf mounting structure, a display shelf extending laterally between and slideably engaged by said spaced-apart side support structures, whereby said display shelf is movable in relation to said side support structures between a normal, fully retracted position and an extended position in which said shelf is positioned forwardly of its fully retracted position, and a position locking mechanism for fixing said display shelf in any of its adjusted positions and comprising a vertically disposed, rotatable locking bar of polygonal cross section with opposed locking edges engageable with a locking track, the improvement characterized by (a) said side support structures each comprising a stiff sheet metal element having front and back ends and an intermediate portion, (b) said intermediate portion being of generally L-shaped cross section comprising a generally vertical outer wall portion and a generally horizontal wall portion joined integrally and in one piece with said outer wall portion and extending laterally inward from said outer wall portion, (c) said generally horizontal wall portions each having an elongated slot formed therein defining said locking track, (d) said elongated slots having width dimensions greater than a minimum cross sectional dimension of said locking bars and less than a maximum cross sectional dimension of said locking bars, and (e) said locking bar having a portion extending vertically into said locking track for engagement of said locking edges with side edges of said locking track.

2. A pull-out display shelf assembly according to claim 1, wherein (a) said vertical shelf mounting structure includes a pair of spaced apart uprights having slotted openings therein, (b) said spaced-apart side support structures have rearwardly extending, notched mounting tabs received in said slotted openings for mounting said side support structures on said uprights, and (c) said spaced-apart side support structures having integral, inwardly bent stabilizing tabs adjacent inner ends thereof for engagement with front surfaces of said uprights to minimize lateral flexing movements of said side support structures relative to said uprights.

3. A pull-out display shelf assembly according to claim 1, wherein (a) said generally horizontal wall portions extend from lower edge portions of said generally vertical outer wall portions.

4. A pull-out display shelf assembly according to claim 1, wherein (a) said horizontal wall portions of said side support structures being of sufficient lateral width to provide panel portions on opposite sides of said elongated slots having width dimensions greater than the width dimensions of said slots.

5. In a pull-out display shelf assembly of the type comprising laterally spaced-apart side support structures engageable at inner ends thereof with a vertical shelf mounting structure, a display shelf extending laterally between and slideably engaged by said spaced-apart side support structures, whereby said display shelf is movable in relation to said side support structures between a normal, fully retracted position and an extended position in which said shelf is positioned forwardly of its fully retracted position, and a position locking mechanism for fixing said display shelf in any of its adjusted positions and comprising a vertically disposed, rotatable locking bar of polygonal cross section with opposed locking edges engageable with a locking track, the improvement characterized by (a) said side support structures each comprising a stiff sheet metal element having front and back ends and an intermediate portion, (b) said intermediate portion being of generally L-shaped cross section comprising a generally vertical outer wall portion and a generally horizontal wall portion joined integrally and in one piece with said outer wall portion and extending laterally inward from said outer wall portion, (c) said side support structures being connected one to the other solely by said shelf mounting structure and by said display shelf, (d) said vertical shelf mounting structure including a pair of spaced apart uprights having slotted openings therein, (e) said spaced-apart side support structures having rearwardly extending, notched mounting tabs received in said slotted openings for mounting said side support structures on said uprights, and (f) said spaced-apart side support structures having integral, laterally bent stabilizing tabs adjacent inner ends thereof for engagement with front surfaces of said uprights to minimize lateral flexing movements of said side support structures relative to said uprights, (g) said generally horizontal wall portion has an elongated slot formed therein defining said locking track, and (h) said locking bar has a portion extending vertically into said locking track for engagement of said locking edges with side edges of said locking track.

* * * * *